United States Patent [19]

Fathergill et al.

[11] B 3,986,227

[45] Oct. 19, 1976

[54] PRINTING SYSTEM HAVING A HOT ROLL FUSER WITH A SCRAPING BLADE CLEANER

[75] Inventors: Rex D. Fathergill, Franklin County; Arthur M. Howarth; Edward L. Soard, both of Lexington, all of Ky.

[73] Assignee: International Business Machines Corporation, Armonk, N.Y.

[22] Filed: May 19, 1975

[21] Appl. No.: 579,116

[44] Published under the second Trial Voluntary Protest Program on February 3, 1976 as document No. B 579,116.

[52] U.S. Cl. ..... 15/256.53; 34/120; 101/425; 355/15

[51] Int. Cl.[2] ..... G03G 15/00

[58] Field of Search ..... 15/256.51, 256.53; 355/3 DD, 15; 101/425; 34/85, 110, 120; 100/174

[56] References Cited

UNITED STATES PATENTS

| | | | |
|---|---|---|---|
| 3,252,416 | 5/1966 | Allen | 101/425 |
| 3,520,410 | 7/1970 | Hutto, Jr. | 210/67 |
| 3,577,649 | 5/1971 | Wadsworth et al. | 15/256.51 X |
| 3,794,417 | 2/1974 | Machmer | 355/3 DD |

*Primary Examiner*—Edward L. Roberts
*Attorney, Agent, or Firm*—Francis A. Sirr

[57] ABSTRACT

In a xerographic printing system the toned copy paper is fused by the pressure nip formed by a hot roll and a backup roll. A scraping blade engages the destructible surface of the backup roll at a critical angle which is selected as a function of the coefficients of friction of the backup roll's surface and the toner/debris contamination that may be collected on the backup roll's surface. As a result, the blade slides freely on the roll's surface, but does not slide on the surface of the toner/debris contamination film. This film forms a locking angle with the blade, placing the blade in stress, and developing a film removing chisel-like action therewith.

9 Claims, 6 Drawing Figures

PRINTING SYSTEM HAVING A HOT ROLL FUSER WITH A SCRAPING BLADE CLEANER

BACKGROUND AND SUMMARY OF THE INVENTION

Hot roll fusers are known as one form of fuser to fix thermoplastic powder images onto carrier material, such as, for example, a sheet of paper. Such powder images are produced by the transfer step of the well known electrophotographic process, also known as xerography. In the hot roll type fuser, it is conventional to provide an internally heated hot roll whose outer surface is deformable. This roll cooperates with a clean and relatively cool backup roll to form a fusing nip through which the toned paper sheet passes, with the toner adjacent the hot roll. These two rolls are maintained together with a force which causes the backup roll to penetrate the deformable surface of the hot roll so as to form a footprint or impression whose area constitutes the fusing area or nip.

In some devices, the fusing nip is opened between copy sheets, while in others the nip remains closed during the inter-copy gap which separates sequentially fed copy sheets. With either type of device, and primarily with the latter type, there is a tendency for toner to accumulate on the backup roll, for example from direct contact with the hot roll, and/or form loose, air-carried toner within the xerographic printing system.

Prior printing systems have provided cleaning means to remove this toner and/or debris from the backup roll. For example, U.S. Pat. No. 3,794,417 discloses a scraper which includes a plurality of individual spring finger blades having sharp leading edges that scrape toner particles from the surface of the backup roll.

The present invention is an improvement to this generic type of scraping blade backup roll cleaner.

The present invention provides a cleaning blade having a sharp leading edge which is positioned in running engagement with the surface of the backup roll. The surface of this roll is preferably covered with a material having low surface energy, to thereby minimize the adhesive forces between the roll and the toner and/or debris. This material constitutes a destructible surface which must be protected from cleaning blade abrasion, and yet the cleaning blade must operate to clean the surface.

To accomplish this result, the cleaning blade of the present invention engages the backup roll's surface at a critical angle. The coefficient of friction of a clean backup roll surface is substantially less than the coefficient of friction of the same surface when it carries toner and/or debris. The sharp leading edge of the cleaning blade engages the roll at an acute angle, which is measured from the tangent to the roll at the point of engagement and in the direction of roll rotation, such that the resultant force component lies within the blade when engaging the clean surface, and lies within the acute angle, i.e. between the blade and the roll, when the blade engages a contamination filmed roll surface.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
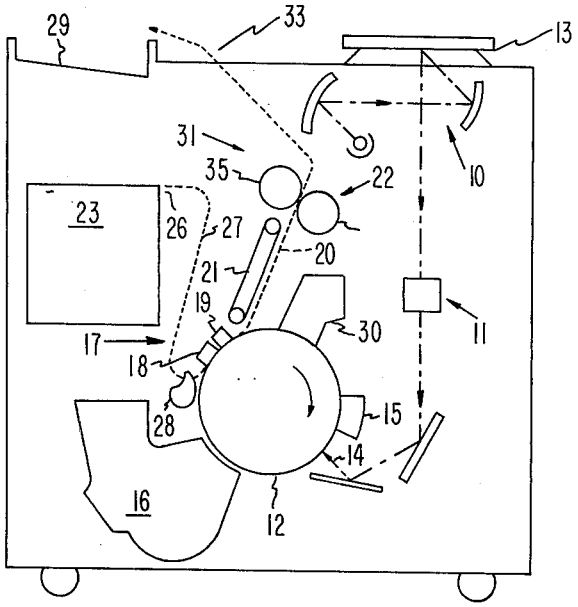
FIG. 1 is a schematic side view of a xerographic copying apparatus incorporating the present invention.

FIG. 1 is a schematic view of a xerographic copying apparatus incorporating the present invention. In this device a scanning mirror system 10 and a moving lens 11 move in synchronism with the rotation of photoconductor drum 12 to place a latent image of an original document 13 onto the drum's surface. As is well known, prior to imaging at 14 the drum is charged by corona 15. After imaging, the drum's latent image is developed by magnetic brush developer 16. Thereafter the drum's toned visible image is transferred to a sheet of copy paper, supplied from copy sheet supply bin 23, at transfer station 17, by operation of transfer corona 18. Sheet detach means 19 thereafter operates to cause the now-toned sheet to leave the surface of the drum and to follow sheet path 20, adjacent vacuum conveyor 21 on its way to hot roll fuser assembly 22. After fusing, the finished copy sheet follows sheet path 33 and is deposited in tray 29. After transfer, the drum is cleaned as it passes cleaning station 30.

A paper feed means within bin 23 is operable to feed the top sheet of the stack to sheet discharge 26. This sheet then travels down sheet path 27 to be momentarily stopped at gate 28. When the leading edge of the drum's toned image arrives at the vicinity of the gate, the gate is opened to allow the sheet to progress into transfer station 17 in exact registry with the drum's image. An exemplary means of picking the top sheet from bin 23 is described in the IBM TECHNICAL DISCLOSURE BULLETIN of Feb. 1974, at pages 2966 and 2967.

Fusing assembly 22 includes a hot roll 34 and a backup roll 35. The construction of the fusing assembly will not be disclosed in detail since constructions of this generic type are well known in the art. Generally, hot roll 34 is heated to an accurately controlled temperature by an internal heater and a temperature control system, not shown. The hot roll preferably includes an external surface formed as a thin elastomeric surface which is designed to engage the toned side of the copy sheet, fuse the toner thereon, and readily release the sheet with a minimum adherance of residual toner to the hot roll's outer surface. Such a hot roll is described, for example, in the IBM TECHNICAL DISCLOSURE BULLETIN of Aug. 1973, at page 896. If desired, a peeler bar may be provided to assist in release of the sheet from hot roll 34.

The nip formed by rolls 34 and 35 is preferably opened and closed in synchronism with the need to fuse a sheet of copy paper, or a serial stream of such sheets. This synchronism is achieved by a drum position sensing means, not shown. An exemplary mechanism for effecting the opening and closing of this nip is shown in the IBM TECHNICAL DISCLOSURE BULLETIN of May 1973, at page 3644.

The present invention provides an improved scraping blade cleaner means 31 to clean the surface of backup roll 35.

Figure 2:
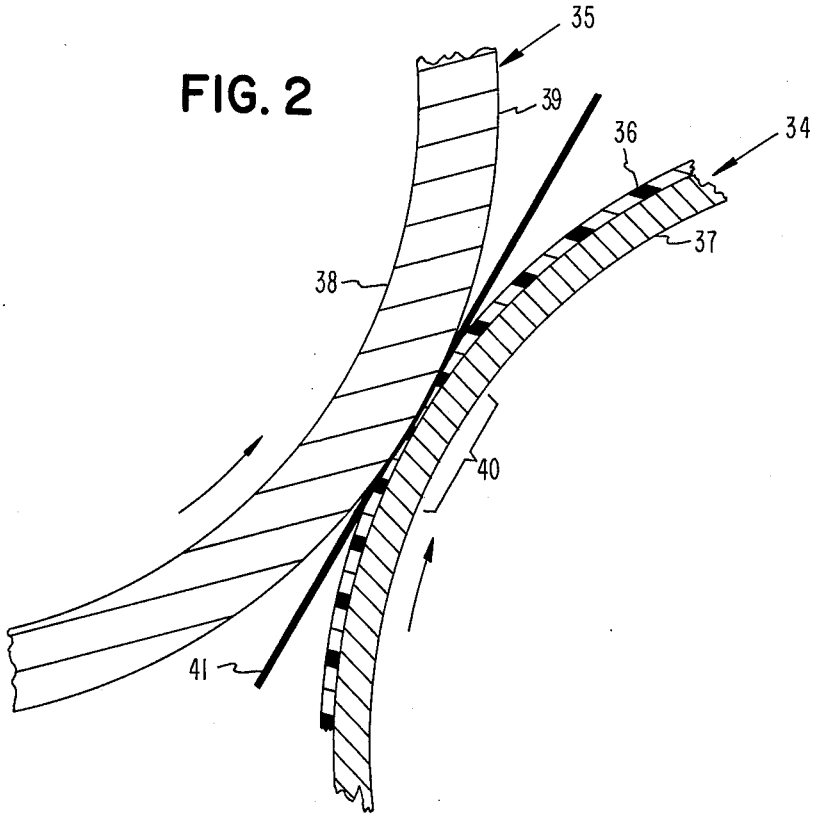
FIG. 2 is an enlarged side view of the fusing nip formed by the hot roll and the backup roll of FIG. 1.

With reference to FIG. 2, the hot roll 34 is preferably an aluminum cylinder 37 coated with a relatively soft silicone elastomer layer 36. A pair of insulating end walls are fitted into the cylinder at each end and support bearings which operate to support the cylinder for rotation. A conventional tungsten filament infrared heating lamp is located along this rotational axis. A reflective end plate may be carried within the cylinder, at each end, to improve the axial uniformity of heat reception by the cylinder from the heating lamp. The inner surface of the cylinder may be colored black to improve its radiant energy absorption.

Backup roll 35 is also an aluminum cylinder 38, having a relatively heavy wall thickness. The outer surface of the backup roll is honed and lapped for smoothness. The outer coating layer 39 of the backup roll provides a thin insulating surface which minimizes the reception of heat by the backup roll from the hot roll. This layer must be thin to enable such heat as is acquired to rapidly spread throughout cylinder 38, to insure that the backup roll does not acquire large thermal gradients along its axis.

Layer 39 is a destructible layer; therefore, its cleaning means must be constructed and arranged so as to clean the layer without damage. This layer may comprise, for example, aluminum oxide, chromium oxide, polytetrafluoroethelene, or aluminum oxide embedded within polytetrafluoroethelene.

As can be seen from FIG. 2, backup roll 38 penetrates the deformable surface 36 of the hot roll so as to form a footprint or impression 40 whose area constitutes the fusing area or nip for copy sheet 41, whose toner faces hot roll 34. Hot roll 34 rotates in a clockwise direction, whereas backup roll 35 rotates counterclockwise.

Figure 3:
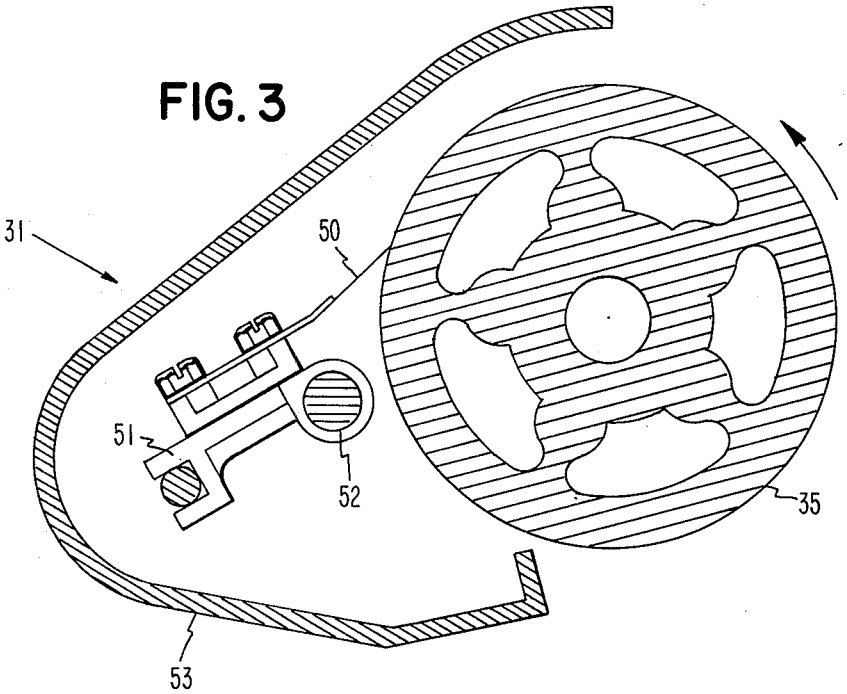
FIG. 3 is a side view of the backup roll and the scraping blade cleaner means of FIG. 1.

Referring to FIG. 3, the scraping cleaner means 31 of FIG. 1 is seen as comprising a relatively narrow cleaning blade 50. This blade is supported on carriage 51. This carriage is slidably supported by rod 54 and axially traverses the surface of backup roll 35, as it moves back and forth on a compound fish-reel type double helix lead screw 52. Blade 50 operates to scrape and remove any toner and/or debris film that may be carried by the backup roll's outer surface. At the extremities of its axial movement blade 50 moves beyond the operative surface of the backup roll, i.e. the surface which cooperates with copy paper to be fused, so that the blade overlaps the end of the backup roll. At this position there seems to be a tendency of the backup roll to clean toner and the like which may have accumulated on the underside of the cleaning blade. Droppings from the cleaning blade are accumulated in a trough 53 carried by the fuser assembly. Preferably the portions of blade 50, excluding its sharp leading edge, are coated with a low surface energy material, such as polytetrafluoroethelene, to minimize adhesion of roller contaminant to the blade.

Figure 4:
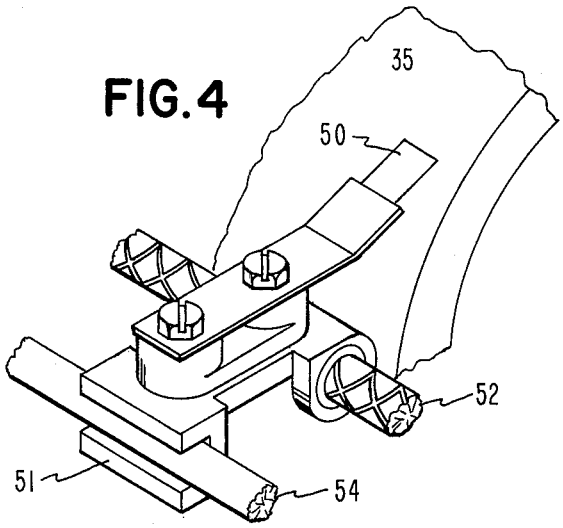
FIG. 4 is a perspective view of the scraping blade cleaner means and backup roll of FIG. 3.

FIG. 4 shows the scraping cleaning means in perspective.

Figure 5:
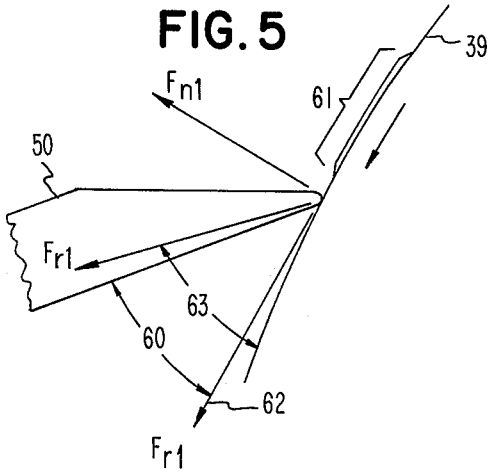
FIG. 5 is a side view of the scraping blade of FIGS. 3 and 4, showing the sharp leading edge of the blade engaging the clean outer surface of the backup roll.
Figure 6:
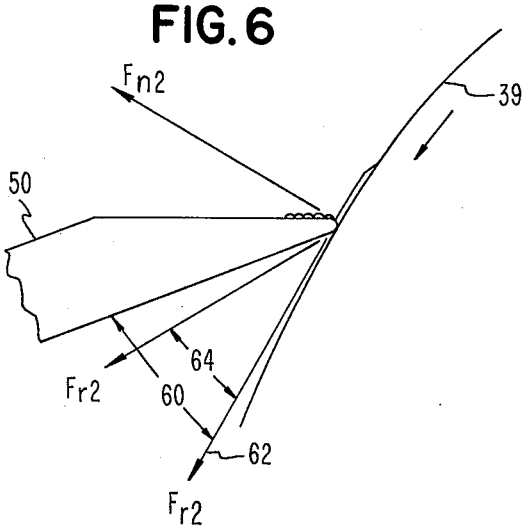
FIG. 6 is a side view similar to FIG. 5 wherein the scraping blade is shown encountering a dirt film carried by the backup roll's outer surface.

With reference to FIGS. 5 and 6, the scraping blade cleaner means of the present invention is constructed and arranged such that the sharp leading edge of scraping blade 50 engages the destructible surface 39 of the backup roll at a critical acute angle 60. This angle is a function of the coefficient of friction of the backup roll's surface 39, designated $\mu 1$, and the coefficient of friction of a dirt contaminated portion 61 of that surface, designated $\mu 2$. By definition $\mu 1$ is significantly lower than $\mu 2$.

The narrow, flexible cleaning blade 50 engages surface 39 with a relatively low contact force Fn, the force Fn being normal to tangent 62 at the point of blade contact.

With reference to FIG. 5, the force component, measured along tangent 62, which the moving backup roll exerts on blade 50 is expressed by the equation:

$$Ft1 = \mu_1 Fn1$$

The resultant force vector Ft1, i.e. the result of quadrature forces Ft1 and Fn1, exists at an angle 63 which lies within blade 50.

With reference to FIG. 6, the force component, measured along tangent 62, which the contaminated surface 39 exerts on blade 50 is expressed by the equation:

$$Ft2 = \mu_2 Fn2$$

Since $\mu_2$ is greater than $\mu_1$, both Fn2 and Ft2 are greater than Fn1 and Ft1, respectively, as shown by the length of the respective vectors in FIGS. 5 and 6. The resultant force vector Ft2 also increases, and now exists at a smaller angle 64, extending between blade 50 and tangent 62.

By selecting the blade angle 60 such that (1) angle 60 is less than angle 63, and (2) angle 60 is greater than angle 64, the force Ft with which the blade operates on surface 39 is minimized with a clean backup roll surface and increases when contamination film 61 arrives to be cleaned.

The forces Ft and Fn are both linear functions of the coefficient of friction of the material engaging the cleaning blade's sharp leading edge. As a result, the increasing coefficient of friction of contaminated surface 61 proportionally increases the force Ft2 (FIG. 6), locking the blade against the contaminated surface. This effect persists with increasing force Ft until (1) the contaminant 61 is removed, or (2) the column bending of flexible blade 50, toward surface 39, causes angle 60 to become equal to, or less than, angle 64. Condition (2) is the upper limit in the magnitude of Fn2. If the contaminant 61 is not removed by this force, the blade's edge will slide over the contaminant. When the contaminant has been removed, the blade's edge again engages a clean surface 39 and the conditions of FIG. 5 are restored, i.e. the locking of the blade against surface 39 ceases.

It is important to note that the critical angle 60 must never become greater than angle 63, i.e. the angle of the resultant force Ft1 when the blade engages a clean surface, as in FIG. 5, since damage to surface 39 and/or blade 50 is then possible.

In a specific device constructed in accordance with this invention the predominant constituent of contaminant 61 was toner, the backup roll's surface 39 was formed of polytetrafluoroethelene, the coefficients of friction of surface 39 and contaminant 61, with respect to a steel blade 50, were as listed in the following tables:

STATIC $\mu$

| | 72°F | 150°F | 200°F |
|---|---|---|---|
| surface 39 | .240 to .260 | .100 to .160 | .013 to .065 |

-continued

STATIC $\mu$

| | 72°F | 150°F | 200°F |
|---|---|---|---|
| surface 61 | .240 to .360 | .330 | 1.090 to 1.120 |

The dynamic coefficients of friction, with surface 39 moving at 15 inches per second was:

DYNAMIC $\mu$

| | 72°F | 150°F | 200°F |
|---|---|---|---|
| surface 39 | .130 to .260 | .065 to .130 | .010 to .065 |
| surface 61 | .130 to .260 | .160 to .330 | .330 to .360 |

While the exemplary blade structure shown in FIGS. 3 and 4 is a preferred arrangement, the present invention is not to be limited thereto, since different blade configurations can provide the critical geometry shown in FIGS. 5 and 6. For example, within the teachings of the present invention, blade 50 may be formed in a Z-shape such that an excessively large locking force Ft2, FIG. 6, will tend to flex the mid-portion of the Z and cause the blade's sharp leading edge to be lifted away from and then ride over contaminant 61.

While the invention has been particularly shown and described with reference to preferred embodiments thereof, it will be understood by those skilled in the art that various changes in form and details may be made therein without departing from the spirit and scope of the invention.

What is claimed is:

1. A scraping cleaning apparatus for cleaning contaminating material from the surface of a roll, wherein the coefficient of friction of the roll's surface is less than the coefficient of friction of the contaminating material, the apparatus comprising:

a scraping blade having a sharp leading edge positioned to engage the advancing surface of said roll with a given force and at a critical acute angle from the tangent to the roll at the point of engagement, said critical angle being such that the friction-derived force vector lies at a greater angle than said critical angle when said leading edge engages a clean roll surface, and such that the higher friction-derived force vector lies at a lesser angle than said critical angle when said leading edge engages a contaminated roll surface.

2. The cleaning apparatus defined in claim 1 wherein said roll is of a finite axial length and rotates in a direction to advance against the leading edge of said blade, wherein said scraping blade is narrow as compared to the length of said roll, and including drive means to oscillate said blade axially back and forth across said roll.

3. In an electrophotographic copying apparatus having a hot roll fuser, a scraping blade cleaning apparatus for cleaning the fuser's backup roll, comprising:

a fuser backup roll having an outer surface whose coefficient of friction is of a lower value than the coefficient of friction of the same surface when coated with a contaminant; and a scraping blade having a sharp leading edge positioned to engage the advancing surface of said roll with a given force bias and at a critical acute angle which is measured from the tangent to the roll at the point of engagement, said critical angle being a function of the two stated coefficients of friction and being such that the friction-derived force vector for a clean roll lies at a greater angle to said tangent than said critical angle, and the larger magnitude friction-derived force vector for a contaminated roll lies at a lesser angle to said tangent than said critical angle.

4. In an electrophotographic copying apparatus as defined in claim 3, including a low surface energy material covering said backup roll and portions of said scraping blade excluding said leading edge.

5. The electrophotographic copying apparatus defined in claim 4 wherein said roll and said scraping blade are metallic, and said material having a low surface energy is polytetrafluoroethelene.

6. In an electrophotographic copying apparatus as defined in claim 3, wherein said backup roll is of a finite axial length and rotates in a direction to advance its outer surface into the leading edge of said blade, wherein said blade is narrow as compared to the axial length of said roll, and including drive means to oscillate said blade axially back and forth across said roll.

7. In an electrophotographic copying apparatus as defined in claim 6 wherein said contaminant includes toner, wherein said roll is metallic, and including a low surface energy material coating on said backup roll.

8. In an electrophotographic copying apparatus as defined in claim 7 wherein said blade is metallic, and including a low surface energy material coating surfaces of said blade excluding said leading edge.

9. The electrophotographic copying apparatus defined in claim 8 wherein said low surface energy material is polytetrafluoroethelene.

* * * * *